US009303460B2

(12) United States Patent
Schwefe et al.

(10) Patent No.: US 9,303,460 B2
(45) Date of Patent: Apr. 5, 2016

(54) CUTTING ELEMENT RETENTION FOR HIGH EXPOSURE CUTTING ELEMENTS ON EARTH-BORING TOOLS

(71) Applicant: Baker Hughes Incorporated, Houston, TX (US)

(72) Inventors: Thorsten Schwefe, Virginia Water (GB); Kenneth R. Evans, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 406 days.

(21) Appl. No.: 13/755,629

(22) Filed: Jan. 31, 2013

(65) Prior Publication Data

US 2013/0199857 A1 Aug. 8, 2013

Related U.S. Application Data

(60) Provisional application No. 61/594,768, filed on Feb. 3, 2012.

(51) Int. Cl.

| | |
|---|---|
| ***E21B 10/43*** | (2006.01) |
| ***E21B 10/50*** | (2006.01) |
| ***E21B 10/55*** | (2006.01) |
| ***E21B 10/573*** | (2006.01) |

(52) U.S. Cl.

CPC ..... *E21B 10/50* (2013.01); *E21B 10/55* (2013.01); *E21B 10/573* (2013.01)

(58) Field of Classification Search

CPC ..... E21B 10/55; E21B 10/567; E21B 10/573; E21B 10/5735; E21B 10/43

USPC ..... 175/432, 428, 426

See application file for complete search history.

(56) References Cited

U.S. PATENT DOCUMENTS

| | | | |
|---|---|---|---|
| 875,664 | A | 12/1907 | Karns |
| 3,726,352 | A | 4/1973 | Roos |
| 4,014,395 | A | 3/1977 | Pearson |
| 4,199,035 | A | 4/1980 | Thompson |
| 4,200,159 | A | 4/1980 | Peschel et al. |

(Continued)

FOREIGN PATENT DOCUMENTS

| | | | |
|---|---|---|---|
| GB | 2084219 | A | 4/1982 |

OTHER PUBLICATIONS

International Search Report for International Application No. PCT/US2013/024382 dated May 14, 2013, 3 pages.

(Continued)

*Primary Examiner* — Kenneth L Thompson
(74) *Attorney, Agent, or Firm* — TraskBritt

(57) ABSTRACT

Earth-boring tools include a cutting element mounted to a body that comprises a metal or metal alloy, such as steel. A cutting element support member is mounted to the body rotationally behind the cutting element. The cutting element support member has an at least substantially planar support surface at a first end thereof, and a lateral side surface extending from the support surface to an opposing second end of the cutting element support member. The cutting element has a volume of superabrasive material on a first end of a substrate, and a lateral side surface extending from the first end of the substrate to an at least substantially planar back surface. The at least substantially planar back surface of the cylindrical substrate abuts an at least substantially planar support surface of the cutting element support member.

18 Claims, 6 Drawing Sheets

(56) References Cited

U.S. PATENT DOCUMENTS

| | | | | | |
|---|---|---|---|---|---|
| 4,271,917 | A | | 6/1981 | Sahley | |
| 4,334,585 | A | | 6/1982 | Upton | |
| 4,337,980 | A | | 7/1982 | Krekeler | |
| 4,351,401 | A | * | 9/1982 | Fielder | 175/428 |
| 4,382,477 | A | | 5/1983 | Barr | |
| 4,453,605 | A | | 6/1984 | Short et al. | |
| 4,465,148 | A | | 8/1984 | Morris et al. | |
| 4,505,342 | A | * | 3/1985 | Barr et al. | 175/428 |
| 4,529,048 | A | | 7/1985 | Hall | |
| 4,538,690 | A | | 9/1985 | Short | |
| 4,553,615 | A | | 11/1985 | Grainger | |
| 4,782,903 | A | | 11/1988 | Strange | |
| 4,877,096 | A | | 10/1989 | Tibbitts | |
| 4,993,505 | A | | 2/1991 | Packer et al. | |
| 5,007,493 | A | | 4/1991 | Coolidge et al. | |
| 5,056,382 | A | | 10/1991 | Clench | |
| 5,213,171 | A | | 5/1993 | Clench et al. | |
| 5,279,375 | A | | 1/1994 | Tibbitts | |
| 5,332,051 | A | * | 7/1994 | Knowlton | 175/430 |
| 5,431,239 | A | * | 7/1995 | Tibbitts et al. | 175/428 |
| 5,533,582 | A | * | 7/1996 | Tibbitts | 175/430 |
| H1566 | H | | 8/1996 | Azar | |
| 5,558,170 | A | | 9/1996 | Thigpen et al. | |
| 5,678,645 | A | | 10/1997 | Tibbitts et al. | |
| 5,833,017 | A | | 11/1998 | Woods et al. | |
| 5,890,552 | A | | 4/1999 | Scott et al. | |
| 5,906,245 | A | | 5/1999 | Tibbitts et al. | |
| 6,006,846 | A | * | 12/1999 | Tibbitts et al. | 175/428 |
| 6,302,224 | B1 | | 10/2001 | Sherwood, Jr. | |
| 6,427,791 | B1 | | 8/2002 | Glowka | |
| 7,070,011 | B2 | | 7/2006 | Sherwood, Jr. et al. | |
| 7,096,978 | B2 | * | 8/2006 | Dykstra et al. | 175/57 |
| 7,909,121 | B2 | * | 3/2011 | Voronin et al. | 175/435 |
| 8,011,456 | B2 | | 9/2011 | Sherwood, Jr. | |
| 8,061,455 | B2 | * | 11/2011 | Beuershausen | 175/426 |
| 2006/0278441 | A1 | * | 12/2006 | Cooley et al. | 175/374 |
| 2007/0151770 | A1 | * | 7/2007 | Ganz | 175/426 |
| 2007/0278017 | A1 | | 12/2007 | Shen et al. | |
| 2008/0236900 | A1 | | 10/2008 | Cooley et al. | |
| 2009/0020339 | A1 | * | 1/2009 | Sherwood, Jr. | 175/426 |
| 2010/0175929 | A1 | | 7/2010 | Schwefe | |
| 2011/0083909 | A1 | | 4/2011 | Shen et al. | |
| 2011/0266071 | A1 | * | 11/2011 | Lind | 175/428 |

OTHER PUBLICATIONS

International Written Opinion for International Application No. PCT/US2013/024382 dated May 14, 2013, 4 pages.

International Preliminary Report on Patentability for International Application No. PCT/US2013/024382 dated Aug. 5, 2014, 5 pages.

* cited by examiner

CUTTING ELEMENT RETENTION FOR HIGH EXPOSURE CUTTING ELEMENTS ON EARTH-BORING TOOLS

CROSS-REFERENCE TO RELATED APPLICATION

This application claims the benefit of U.S. Provisional Patent Application No. 61/594,768, filed Feb. 3, 2012, the disclosure of which is hereby incorporated herein in its entirety by this reference.

FIELD

Embodiments of the present disclosure generally relate to earth-boring tools, such as rotary drill bits, that include have cutting elements fixedly attached to a body comprising a metal or metal alloy, such as steel.

BACKGROUND

Earth-boring tools are commonly used for forming (e.g., drilling and reaming) bore holes or wells (hereinafter "wellbores") in earth formations. Earth-boring tools include, for example, rotary drill bits, coring bits, eccentric bits, bicenter bits, reamers, underreamers, and mills.

Different types of earth-boring rotary drill bits are known in the art including, for example, fixed-cutter bits (which are often referred to in the art as "drag" bits), rolling-cutter bits (which are often referred to in the art as "rock" bits), superabrasive-impregnated bits, and hybrid bits (which may include, for example, both fixed cutters and rolling cutters). The drill bit is rotated and advanced into the subterranean formation. As the drill bit rotates, the cutters or abrasive structures thereof cut, crush, shear, and/or abrade away the formation material to form the wellbore.

The drill bit is coupled, either directly or indirectly, to an end of what is referred to in the art as a "drill string," which comprises a series of elongated tubular segments connected end-to-end that extends into the wellbore from the surface of the formation. Often various tools and components, including the drill bit, may be coupled together at the distal end of the drill string at the bottom of the wellbore being drilled. This assembly of tools and components is referred to in the art as a "bottom hole assembly" (BHA).

The drill bit may be rotated within the wellbore by rotating the drill string from the surface of the formation, or the drill bit may be rotated by coupling the drill bit to a downhole motor, which is also coupled to the drill string and disposed proximate the bottom of the wellbore. The downhole motor may comprise, for example, a hydraulic Moineau-type motor having a shaft, to which the drill bit is attached, that may be caused to rotate by pumping fluid (e.g., drilling mud or fluid) from the surface of the formation down through the center of the drill string, through the hydraulic motor, out from nozzles in the drill bit, and back up to the surface of the formation through the annular space between the outer surface of the drill string and the exposed surface of the formation within the wellbore.

BRIEF SUMMARY

In some embodiments, the present disclosure includes earth-boring tools, such as rotary drill bits. The tools have a body comprising a metal or metal alloy, such as steel, and at least one cutting element support member mounted on the body. The tools further include at least one polycrystalline diamond compact (PDC) cutting element mounted on the body adjacent and rotationally preceding the cutting element support member. The cutting element support member has an at least substantially planar support surface at a first end thereof, and a tapered lateral side surface extending from the support surface to an opposing second end of the cutting element support member. The PDC cutting element has a volume of polycrystalline diamond (or other superabrasive material, such as cubic boron nitride) on a first end of a cylindrical substrate. The cylindrical substrate has a cylindrical lateral side surface extending from the first end of the cylindrical substrate to an at least substantially planar back surface at an opposing second end of the cylindrical substrate. The at least substantially planar back surface of the cylindrical substrate abuts the at least substantially planar support surface of the cutting element support member.

In additional embodiments, the present disclosure includes methods of fabricating earth-boring tools, such as rotary drill bits. In accordance with the methods, a cutting element support member is mounted on a body comprising a metal or metal alloy, such as steel. A PDC cutting element is mounted on the body at a location adjacent and rotationally preceding the cutting element support member. The cutting element support member mounted on the body has an at least substantially planar support surface at a first end of the cutting element support member, and a tapered lateral side surface extending from the support surface to an opposing second end of the cutting element support member. The PDC cutting mounted on the body has a volume of polycrystalline diamond (or another superabrasive material such as cubic boron nitride) on a first end of a cylindrical substrate. The cylindrical substrate has a cylindrical lateral side surface extending from the first end of the cylindrical substrate to an at least substantially planar back surface at an opposing second end of the cylindrical substrate. The PDC cutting element is mounted to the body such that the at least substantially planar back surface of the cylindrical substrate abuts the at least substantially planar support surface of the cutting element support member.

BRIEF DESCRIPTION OF THE DRAWINGS

While the specification concludes with claims particularly pointing out and distinctly claiming what are regarded as embodiments of the disclosure, various features and advantages of this disclosure may be more readily ascertained from the following description of example embodiments provided with reference to the accompanying drawings, in which:

DETAILED DESCRIPTION

The illustrations presented herein are not actual views of any particular earth-boring tool, cutting element, or component thereof, but are merely idealized representations that are employed to describe embodiments of the present disclosure.

As used herein, the term "earth-boring tool" means and includes any tool used to remove formation material and form a bore (e.g., a wellbore) through the formation by way of the removal of the formation material. Earth-boring tools include, for example, rotary drill bits (e.g., fixed-cutter or "drag" bits and roller cone or "rock" bits), hybrid bits including both fixed cutters and roller elements, coring bits, percussion bits, bi-center bits, reamers (including expandable reamers and fixed-wing reamers), and other so-called "hole-opening" tools.

Figure 1:
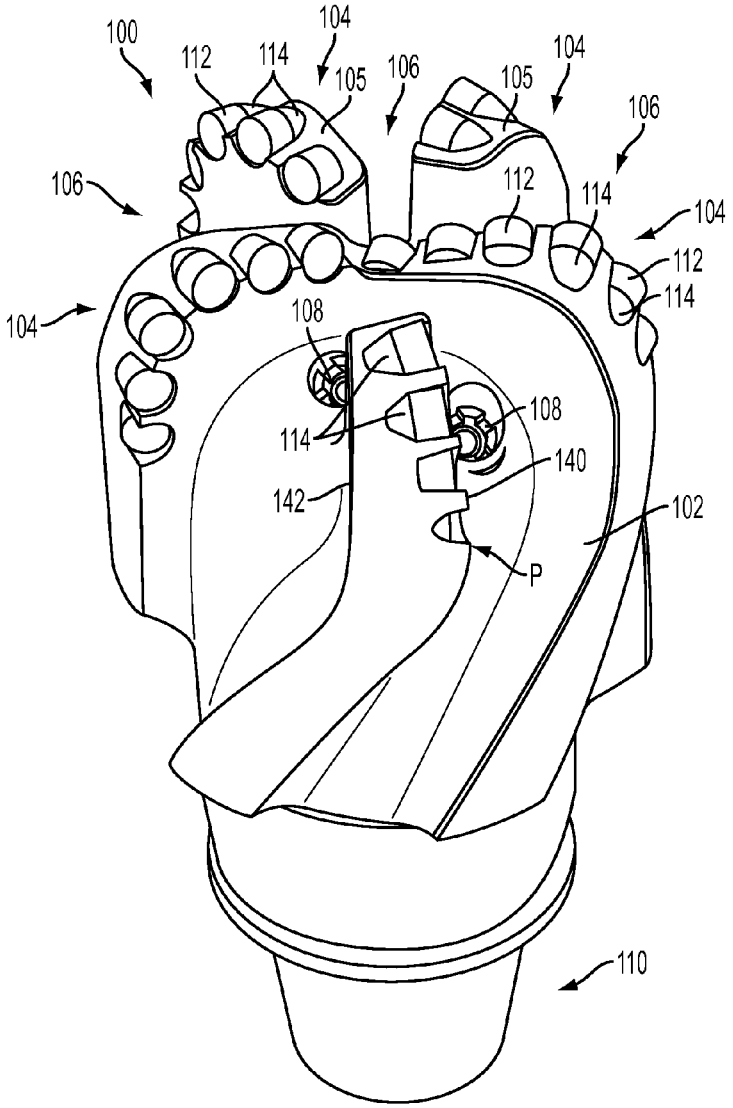
FIG. 1 is an isometric view of an earth-boring rotary drill bit having a steel bit body with fixed cutters mounted thereon and supported by cutting element support members as described herein.

FIG. 1 is an isometric view of an earth-boring tool in the form of a fixed-cutter rotary drill bit 100. The drill bit 100 includes a bit body 102. The bit body 102 may comprise a metal or metal alloy, and may be at least substantially comprised of a metal or metal alloy. For example, the bit body 102 may comprise an iron-based alloy, such as steel. The bit body 102 may comprise a plurality of radially and longitudinally extending blades 104. A plurality of fluid channels 106 may be defined between the blades 104. The fluid channels 106 extend over the bit body 102 between the blades 104. During drilling, drilling fluid may be pumped from the surface of the formation down the wellbore through a drill string to which the drill bit 100 is coupled, through the drill bit 100 and out fluid ports 108 in the bit body 102. The drilling fluid then flows across the face of the drill bit 100, through the fluid channels 106, to the annulus between the drill pipe and the wellbore, where it flows back up through the wellbore to the surface of the formation. The drilling fluid may be circulated in this manner during drilling to flush cuttings away from the drill bit and up to the surface of the formation, and to cool the drill bit 100 and other equipment in the drill string.

The drill bit 100 has a connection end 110 that is adapted for coupling of the drill bit to drill pipe or another component of what is referred to in the art as a "bottom-hole assembly" (BHA). The connection end 110 may comprise, for example, a threaded pin that conforms to industry standards specified by the American Petroleum Institute (API).

As shown in FIG. 1, the drill bit 100 further includes a plurality of cutting elements 112. Cutting elements 112 may be mounted on each of the blades 104 of the bit body 102. By way of example and not limitation, the cutting elements 112 may comprise polycrystalline diamond compact (PDC) cutting elements that include a volume of polycrystalline diamond on a surface of a cutting element substrate.

In accordance with embodiments of the present disclosure, at least some of the cutting elements 112 may exhibit a relatively high exposure over the surrounding outer surfaces of the blades 104 relatively to most previously known drill bits, as discussed in further detail herein below.

The drill bit 100 further includes cutting element support members 114 associated with at least some of the cutting elements 112. Each cutting element support member 114 may be located adjacent and rotationally behind (relative to the direction of rotation of the drill bit 100 during drilling) the cutting element 112 with which it is respectively associated. In other words, cutting elements 112 may be mounted on the bit body 102 at locations adjacent and immediately rotationally preceding the cutting element support members 114 with which each is respectively associated. Cutting elements 112 having common, conventional geometries, when mounted to a body 102 comprising a metal or metal alloy with a relatively high exposure may be susceptible to fracture during drilling, due to decreased structural support from the surrounding bit body 102.

Figure 2:
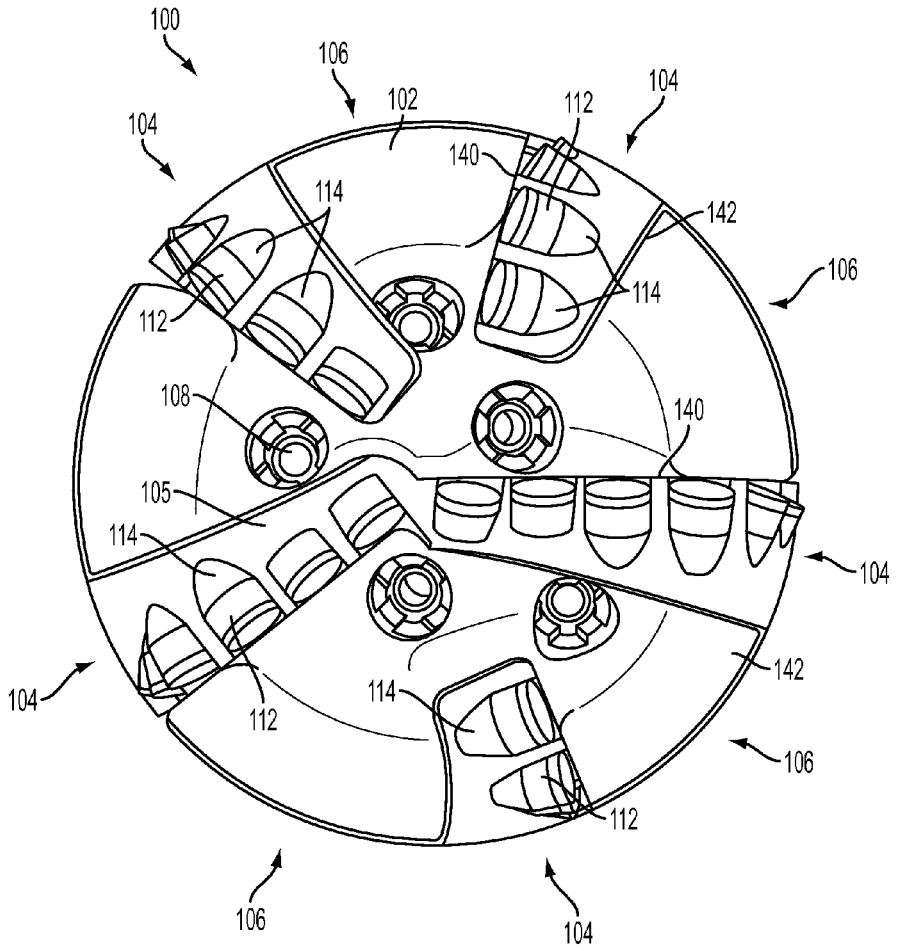
FIG. 2 is a plan view of the cutting end of the earth-boring rotary drill bit shown in FIG. 1.

FIG. 2 is a plan view of the cutting end of the drill bit 100. As known in the art, fixed-cutter rotary drill bits have an outer face that includes an inner inverted cone region proximate a longitudinal central axis of the drill bit, a nose region, a shoulder region, and a gage region. As shown in FIG. 2, the cutting elements 112 in the nose region of the drill bit 100 may have a relatively high exposure, as described herein, and may be supported by respective cutting element support members 114. The cutting elements 112 in other regions, such as the inner inverted cone region, the shoulder region, and the gage region may or may not have a relatively high exposure. If they do have a relatively high exposure, they also may be supported by respective cutting element support members 114. As a result, in some embodiments, cutting elements 112 in one or more regions of the drill bit 100 may not include respective cutting element support members 114.

Figure 3:
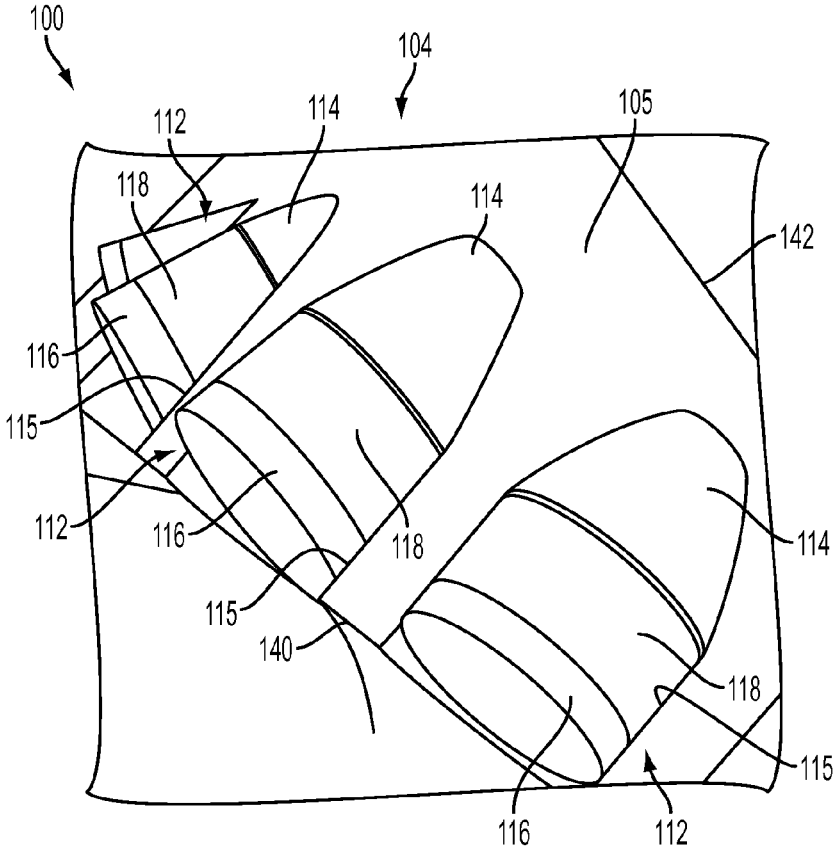
FIG. 3 is an enlarged partial view illustrating several cutting elements and cutting element support members on the earth-boring rotary drill bit shown in FIG. 1.

FIG. 3 is an enlarged view of several cutting elements 112 and respective cutting element support members 114 on the drill bit 100. As shown in FIG. 3, the cutting elements 112 and the cutting element support members 114 may be partially disposed in pockets 115 formed in the blades 104 of the bit body 102 of the drill bit 100. As previously mentioned, the cutting elements 112 adjacent the cutting element support members 114 may exhibit a relatively high exposure over the surrounding outer surfaces 105 of the blades 104.

Figure 4:
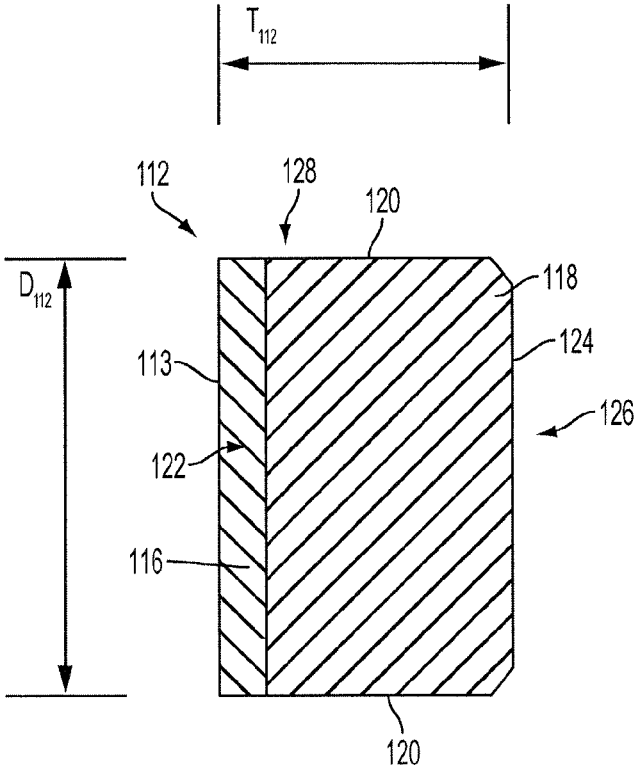
FIG. 4 is a cross-sectional view of a cutting element that may be used in embodiments of earth-boring rotary drill bits as described herein.

FIG. 4 is a simplified and schematically illustrated cross-sectional view of a cutting element 112. As shown in FIG. 4, the cutting element 112 may include a volume of superabrasive material, such as a volume of polycrystalline diamond 116 (or cubic boron nitride), and a substrate 118. The volume of polycrystalline diamond 116 may be disposed on the substrate 118. The cutting element 112 and the cutting element substrate 118 may be generally cylindrical in shape in some embodiments. The cutting element substrate 118 may have a cylindrical lateral side surface 120 extending from a first end 122 of the cylindrical substrate 118 (on which the volume of polycrystalline diamond 116 is disposed) to an at least substantially planar back surface 124 at an opposing second end 126 of the cylindrical substrate 118. The volume of polycrystalline diamond 116 may be generally planar, and may be formed on or otherwise attached to the first end 122 of the cutting element substrate 118. In some embodiments, the volume of polycrystalline diamond 116 may be at least substantially planar. The interface 128 between the volume of polycrystalline diamond 116 and the substrate 118 may be non-planar, as shown in FIG. 4, or it may be at least substantially planar.

As shown in FIG. 4, the cutting element 112 has a diameter $D_{112}$, and a thickness $T_{112}$ between the front cutting face 113 of the cutting element 112 and the back surface 124 of the substrate 118. In some embodiments, the diameter $D_{112}$ may be between about five millimeters (5 mm) and about twenty five millimeters (25 mm). In some embodiments, the thickness $T_{112}$ of the cutting element 112 may be equal to or less than the diameter $D_{112}$. For example, the thickness $T_{112}$ may be about 100% or less, about 90% or less, about 75% or less, or even 50% or less of the diameter $D_{112}$.

In additional embodiments, the cutting elements 112 may have other shapes. For example, the cutting elements 112 may have a dome-shaped or chisel-shaped or other three-dimensionally shaped end comprising the volume of polycrystalline diamond 116. Further, the cutting elements 112 may have an oval cross-sectional shape, a rectangular cross-sectional shape, or another polygonal cross-sectional shape.

Figure 5:
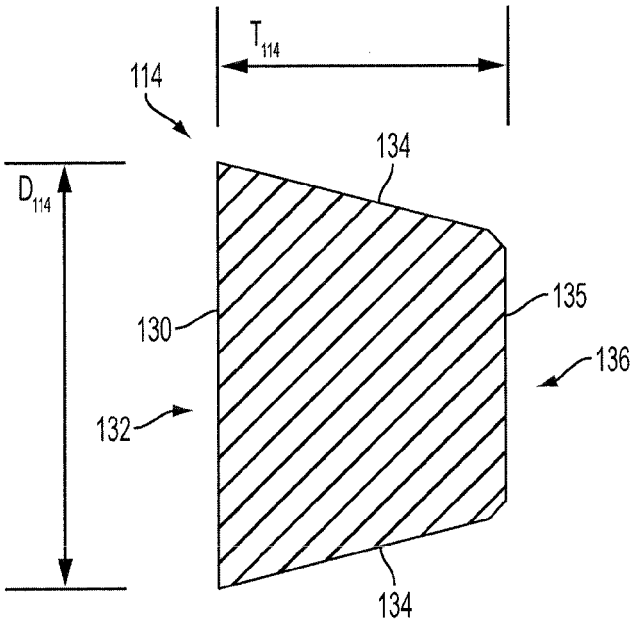
FIG. 5 is a cross-sectional view of a cutting element support member that may be used in embodiments of earth-boring rotary drill bits as described herein.

FIG. 5 is a cross-sectional view of a cutting element support member 114. As shown therein, the cutting element support member 114 may have an at least substantially planar support surface 130 at a first end 132 of the cutting element support member 114, and may have a tapered lateral side surface 134 extending from the support surface 130 to a back surface 135 at an opposing second end 136 of the cutting element support member 114. In some embodiments, the tapered lateral side surface 134 may have a substantially straight profile, such that the tapered lateral side surface 134 has a frustoconical three-dimensional shape. In other embodiments, the tapered lateral side surface 134 may have a curved profile, such that the tapered lateral side surface 134 has a three-dimensional shape similar to a tapered barrel.

As shown in FIG. 5, the support member 114 has a maximum diameter $D_{114}$ at the support surface 130, and a thickness $T_{114}$ between the support surface 130 and the back surface 135. In some embodiments, the diameter $D_{114}$ may be equal to the diameter $D_{112}$ of the cutting element 112, or at least equal to the diameter of the back surface 124 of the substrate 118 of the cutting element 112. The support surface 130 of the cutting element support member 114 may have a shape and size that are at least substantially identical to the size and shape of the back surface 124 of the substrate 118 of the cutting element 112. In some embodiments, the thickness $T_{114}$ of the cutting element support member 114 may be between about 50% and about 200% of the maximum diameter $D_{114}$ of the cutting element support member 114. More particularly, the thickness $T_{114}$ of the cutting element support member 114 may be between about 75% and about 150% of the maximum diameter $D_{114}$ of the cutting element support member 114.

The cutting element support member 114 may comprise a metal or metal alloy, and may be a least substantially comprised of such a metal or metal alloy. For example, the cutting element support member 114 may be formed from, and comprise, a steel alloy. In additional embodiments, the cutting element support member 114 may comprise a cemented carbide material, such as a cobalt-cemented tungsten carbide.

Figure 6:
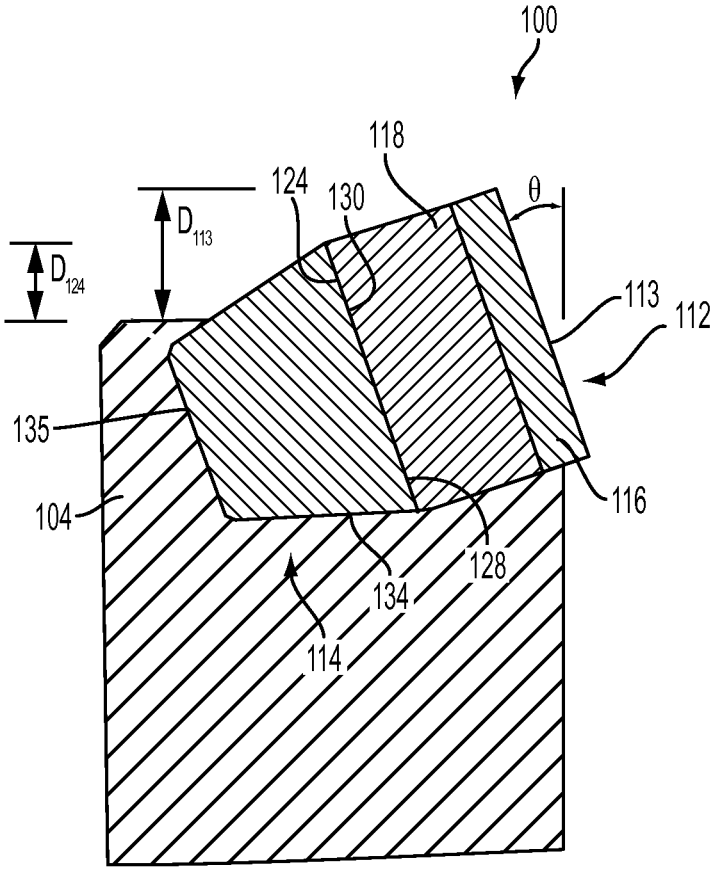
FIG. 6 is an enlarged partial cross-sectional view taken through a cutting element and a cutting element support member on the earth-boring rotary drill bit shown in FIG. 1.

FIG. 6 is a cross-sectional view of a cutting element 112 and a corresponding cutting element support member 114 on a blade 104 of the bit body 102 of the drill bit 100. As shown in FIG. 6, the at least substantially planar back surface 124 of the cylindrical substrate 118 of the cutting element 112 abuts against the at least substantially planar support surface 130 of the cutting element support member 114.

As shown in FIG. 6, the cutting element 112 may be mounted to the blade 104 at a backrake angle θ of from zero degrees)(0°) to about twenty-five degrees (25°). The front cutting face 113 of the cutting element 112 may project outwardly from the surrounding surface 105 of the blade 104 by a distance $D_{113}$ of at least about two and one-half millimeters (2.5 mm), at least about five millimeters (5 mm), at least about ten millimeters (10 mm), or even at least about fifteen millimeters. Similarly, each of the back surface 124 of the substrate 118 of the cutting element 112, and the support surface 130 of the cutting element support member 114, may project outwardly from the surrounding surface 105 of the blade 104 by a distance $D_{124}$ of at least about two and one-half millimeters (2.5 mm), at least about five millimeters (5 mm), at least about ten millimeters (10 mm), or even at least about fifteen millimeters (15 mm).

Thus, the cutting element 112 may exhibit a relatively high exposure over the surface 105 of the blade 104. In some embodiments, the distance $D_{113}$ that the front cutting face 113 of the cutting element 112 projects outwardly from the surrounding surface 105 of the blade 104 may be at least about 30%, at least about 40%, or even at least about 50% of the average diameter $D_{112}$ of the cutting element 112. In some embodiments, the distance $D_{113}$ may be between about 30% and about 60% of the diameter $D_{112}$ of the cutting element 112, between about 40% and about 60% of the diameter $D_{112}$ of the cutting element 112, or even between about 45% and about 60% of the diameter $D_{112}$ of the cutting element 112.

In some embodiments, the back surface 135 of the support member 114 may be entirely embedded within the blade 104 of the bit body 102, as depicted in FIG. 6. In other embodiments, however, a portion of the back surface 135 of the support member 114 may protrude beyond the surrounding outer surface 105 of the blade 104.

The cutting element support members 114 and cutting elements 112 may be formed separately from the bit body 102. Pockets 115 may be formed in the blades 104 of the bit body 102 that are sized and configured to receive the cutting element support members 114 and cutting elements 112 partially therein. The pockets 115 may be formed by, for example, machining the pockets 115 in the blades 104 using one or more of milling and drilling processes. After forming the pockets 115 in the blades 104, the cutting element support members 114 may be positioned in the pockets 115 and bonded to the surrounding surfaces of the blades 104 within the pockets using a brazing process, a welding process, or both. Upon securing the cutting element support members 114 in the pockets 115, the remaining portion of the pockets 115 define the receptacles for receiving the cutting elements 112 therein. The cutting elements 112 may be positioned in the receptacles and bonded to the surrounding surfaces of the blades 104 and the support surfaces 130 of the cutting element support members 114 using a brazing process, a welding process, or both. Such processes may be carried out at temperatures that are sufficiently low to avoid damaging the volume of polycrystalline diamond 116 on the cutting elements 112. Thus, the cutting elements 112 may be mounted to the bit body 102 such that the back surfaces 124 of the substrates 118 of the cutting elements 112 abut directly against the support surfaces 130 of the respective support members 114, but for any brazing or welding material therebetween.

Figure 7:
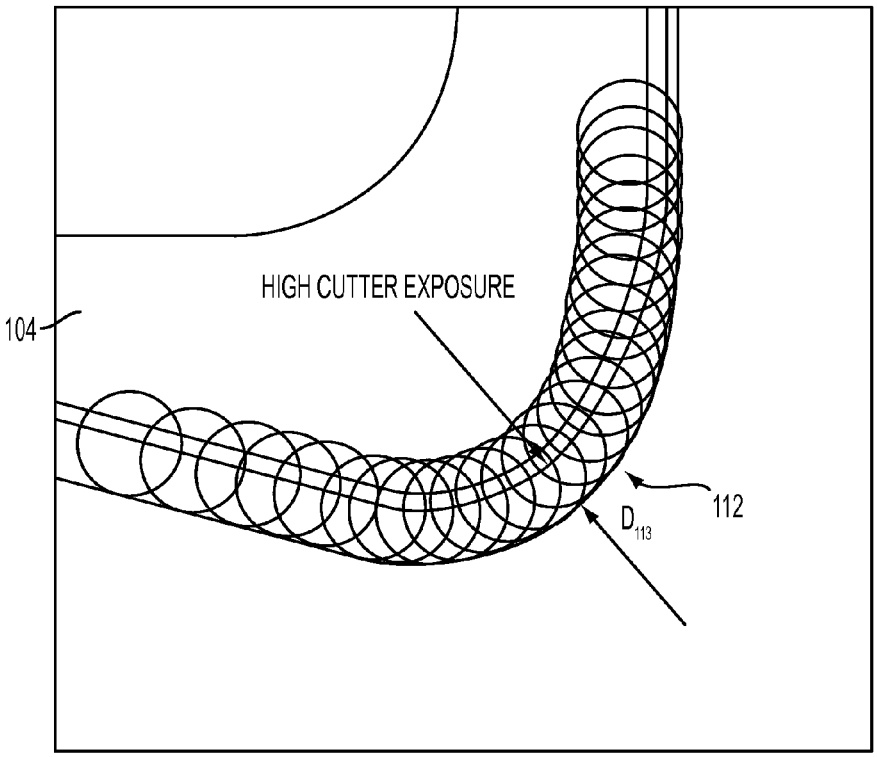
FIG. 7 illustrates a cutting element profile of the earth-boring rotary drill bit shown in FIG. 1.

As previously mentioned, the cutting elements 112 may have a relatively high exposure over the surrounding outer surface 105 of the blades 104. FIG. 7 illustrates the cutting element profile for the drill bit 100 of FIG. 1. The cutting element profile is a diagram illustrating all of the cutting elements 112 of the drill bit 100 rotated into a single plane as if they were mounted on a single blade 104 of the drill bit 100. The cutting element profile illustrates the distance $D_{113}$ by which the front cutting faces 113 of the cutting elements 112 extend outwardly beyond the surrounding outer surface 105 of the blade 104, which distance $D_{113}$ for any particular cutting element 112 is the exposure of that cutting element 112.

As previously mentioned, in some embodiments, at least one of the cutting elements 112 may have an exposure over the outer surface 105 of the blade 104 of the bit body 102 adjacent the cutting element 112 that is between about 30% and about 60%, between about 40% and about 60%, or even between about 45% and about 60% of an average diameter $D_{112}$ of that cutting element 112. As a non-limiting example, a cutting element 112 having an average diameter $D_{112}$ of about 0.75 in. (19 mm) may have an exposure of between about 0.225 in. (5.7 mm) and about 0.450 in. (11.43 mm). A plurality of the cutting elements 112 may have such a relatively high exposure, and, in some embodiments, each of the cutting elements 112 may have such a relatively high exposure.

Referring again to FIG. 1, in some embodiments, the blades 104 of the bit body 102 may be relatively narrow between the rotationally leading surface 140 of the blades 104 and the rotationally trailing surface 142 of the blades 104, so as to provide relatively large fluid channels 106 between the blades 104. By way of example and not limitation, a ratio of the total volume of the fluid channels 106 to the total volume of the bit face may be between about 0.3 and about 0.6 to 1, and more particularly, between about 0.4 and about 0.5 to 1. The total volume of the bit face is defined as the sum of the volume of the fluid channels 106 and the volume of the portions of the blades 104 above (from the perspective of FIG. 1) a plane transverse to a longitudinal axis of the drill bit 100 at the point P at the line of intersection transverse to a longitudinal axis of intersection between the shoulder region and the gage region on the face of the bit body 102. In other words, the total volume of the bit face does not include the volumes of the gage sections of the blades 104 or the portions of the fluid channels 106 between the gage sections of the blades 104, which portions of the fluid channels 106 are often referred to in the art as "junk slots."

By forming the bit body 102 from steel, which is a material that exhibits relatively high strength and high toughness, the blades 104 may be narrowed in comparison to blades formed of, for example, matrix composite materials, and the fluid channels 106 enlarged to enable higher drilling fluid circulation rates during drilling, and by employing cutting element support members 114, the exposure of the cutting elements 112 may be increased. The combination of the above features and characteristics may enable the drill bit 100 to be operated in a relatively aggressive drilling mode without premature fracturing of the blades 104 or loss of cutting elements 112 from the drill bit 100, which may enable drilling at relatively higher rates of penetration (ROP).

Additional non-limiting example embodiments of the disclosure are set forth below.

Embodiment 1

An earth-boring tool, comprising: a steel body; at least one cutting element support member mounted on the steel body, the at least one cutting element support member having an at least substantially planar support surface at a first end of the at least one cutting element support member and a tapered lateral side surface extending from the support surface to an opposing second end of the at least one cutting element support member; and at least one polycrystalline diamond compact (PDC) cutting element mounted on the steel body adjacent and rotationally preceding the at least one cutting element support member, the at least one PDC cutting element having a volume of polycrystalline diamond on a first end of a cylindrical substrate, the cylindrical substrate having a cylindrical lateral side surface extending from the first end of the cylindrical substrate to an at least substantially planar back surface at an opposing second end of the cylindrical substrate, the at least substantially planar back surface of the cylindrical substrate abutting the at least substantially planar support surface of the at least one cutting element support member.

Embodiment 2

The earth-boring tool of Embodiment 1, wherein the at least one cutting element has an exposure over an outer surface of the steel body adjacent the at least one cutting element of between about 30% and about 60% of an average diameter of the at least one PDC cutting element.

Embodiment 3

The earth-boring tool of Embodiment 1 or Embodiment 2, wherein the steel body has a plurality of blades defining fluid channels therebetween, the at least one cutting element mounted on a blade of the plurality of blades.

Embodiment 4

The earth-boring tool of any one of Embodiments 1 through 3, wherein the tapered lateral side surface of the at least one cutting element support member has a frustoconical shape.

Embodiment 5

The earth-boring tool of any one of Embodiments 1 through 4, wherein the at least one cutting element support member comprises a metal alloy.

Embodiment 6

The earth-boring tool of Embodiment 5, wherein the at least one cutting element support member comprises steel.

Embodiment 7

The earth-boring tool of any one of Embodiments 1 through 4, wherein the at least one cutting element support member comprises a cemented carbide material.

Embodiment 8

The earth-boring tool of Embodiment 7, wherein the at least one cutting element support member comprises cobalt-cemented tungsten carbide.

Embodiment 9

The earth-boring tool of any one of Embodiments 1 through 8, wherein the volume of polycrystalline diamond on the first end of the cylindrical substrate of the at least one cutting element is at least substantially planar.

Embodiment 10

The earth-boring tool of any one of Embodiments 1 through 9, wherein a ratio of a total volume of fluid channels to a total volume of a face of the body is between about 0.3 and about 0.6.

Embodiment 11

The earth-boring tool of Embodiment 10, wherein the ratio of the total volume of fluid channels to the total volume of the face of the body is between about 0.4 and about 0.5.

Embodiment 12

A method of fabricating an earth-boring tool, comprising: mounting at least one cutting element support member on a steel body, the at least one cutting element support member having an at least substantially planar support surface at a first end of the at least one cutting element support member and a tapered lateral side surface extending from the support surface to an opposing second end of the at least one cutting element support member; and mounting at least one polycrystalline diamond compact (PDC) cutting element on the steel body adjacent and rotationally preceding the at least one cutting element support member, the at least one PDC cutting element having a volume of polycrystalline diamond on a first end of a cylindrical substrate, the cylindrical substrate having a cylindrical lateral side surface extending from the first end of the cylindrical substrate to an at least substantially planar back surface at an opposing second end of the cylindrical substrate, the at least substantially planar back surface of the cylindrical substrate abutting the at least substantially planar support surface of the at least one cutting element support member.

Embodiment 13

The method of Embodiment 12, wherein mounting the at least one PDC cutting element on the steel body comprises positioning the at least one PDC cutting element on the steel body such that the at least one PDC cutting element has an exposure over an outer surface of the steel body adjacent the at least one cutting element of between about 30% and about 60% of an average diameter of the at least one PDC cutting element.

Embodiment 14

The method of Embodiment 12 or Embodiment 13, further comprising selecting the steel body to comprise a plurality of blades defining fluid channels therebetween, and wherein mounting the at least one PDC cutting element on the steel body comprises mounting the at least one PDC cutting element on a blade of the plurality of blades.

Embodiment 15

The method of any one of Embodiments 12 through 14, wherein the tapered lateral side surface of the at least one cutting element support member has a frustoconical shape.

Embodiment 16

The method of any one of Embodiments 12 through 15, further comprising selecting the at least one cutting element support member to comprise a metal alloy.

Embodiment 17

The method of Embodiment 16, further comprising selecting the at least one cutting element support member to comprise steel.

Embodiment 18

The method of any one of Embodiments 12 through 15, further comprising selecting the at least one cutting element support member to comprise a cemented carbide material.

Embodiment 19

The method of Embodiment 18, further comprising selecting the at least one cutting element support member to comprise cobalt-cemented tungsten carbide.

Embodiment 20

The method of any one of Embodiments 12 through 19, wherein mounting at least one cutting element support member on the steel body comprises brazing the at least one cutting element support member to the steel body.

Embodiment 21

The method of any one of Embodiments 12 through 20, wherein mounting at least one cutting element support member on the steel body comprises welding the at least one cutting element support member to the steel body.

Although the foregoing description contains many specifics, these are not to be construed as limiting the scope of the present invention, but merely as providing certain embodiments. Similarly, other embodiments of the invention may be devised which do not depart from the scope of the present invention. For example, features described herein with reference to one embodiment also may be provided in others of the embodiments described herein. The scope of the invention is, therefore, indicated and limited only by the appended claims and their legal equivalents, rather than by the foregoing description. All additions, deletions, and modifications to the invention, as disclosed herein, which fall within the meaning and scope of the claims, are encompassed by the present invention.

What is claimed is:

1. An earth-boring tool, comprising:

a steel body;

at least one cutting element support member mounted on the steel body, the at least one cutting element support member having an at least substantially planar support surface at a first end of the at least one cutting element support member and a tapered lateral side surface with a circular cross section along an axis normal to the planar support surface, the tapered lateral side surface extending from the support surface to an opposing second end of the at least one cutting element support member; and at least one polycrystalline diamond compact (PDC) cutting element mounted on the steel body adjacent and rotationally preceding the at least one cutting element support member, the at least one PDC cutting element having a volume of polycrystalline diamond on a first end of a cylindrical substrate, the cylindrical substrate having a cylindrical lateral side surface extending from the first end of the cylindrical substrate to an at least substantially planar back surface at an opposing second end of the cylindrical substrate, the at least substantially planar back surface of the cylindrical substrate abutting the at least substantially planar support surface of the at least one cutting element support member, wherein the at least one PDC cutting element has an exposure over an outer surface of the steel body adjacent the at least one cutting element of between about 30% and about 60% of an average diameter of the at least one PDC cutting element.

2. The earth-boring tool of claim 1, wherein the steel body has a plurality of blades defining fluid channels therebetween, the at least one PDC cutting element mounted on a blade of the plurality of blades.

3. The earth-boring tool of claim 1, wherein the tapered lateral side surface of the at least one cutting element support member has a frustoconical shape.

4. The earth-boring tool of claim 1, wherein the at least one cutting element support member comprises a metal alloy.

5. The earth-boring tool of claim 4, wherein the at least one cutting element support member comprises steel.

6. The earth-boring tool of claim 1, wherein the at least one cutting element support member comprises a cemented carbide material.

7. The earth-boring tool of claim 6, wherein the at least one cutting element support member comprises cobalt-cemented tungsten carbide.

8. The earth-boring tool of claim 1, wherein the volume of polycrystalline diamond on the first end of the cylindrical substrate of the at least one PDC cutting element is at least substantially planar.

9. The earth-boring tool of claim 1, wherein a ratio of a total volume of fluid channels to a total volume of a face of the body is between about 0.3 and about 0.6 to 1.

10. The earth-boring tool of claim 9, wherein the ratio of the total volume of fluid channels to the total volume of the face of the body is between about 0.4 and about 0.5 to 1.

11. A method of fabricating an earth-boring tool, comprising:

mounting at least one cutting element support member on a steel body, the at least one cutting element support member having an at least substantially planar support surface at a first end of the at least one cutting element support member and a tapered lateral side surface with a circular cross section along an axis normal to the planar support surface, the tapered lateral side surface extending from the support surface to an opposing second end of the at least one cutting element support member; and mounting at least one polycrystalline diamond compact (PDC) cutting element on the steel body adjacent and rotationally preceding the at least one cutting element support member, the at least one PDC cutting element having a volume of polycrystalline diamond on a first end of a cylindrical substrate, the cylindrical substrate having a cylindrical lateral side surface extending from the first end of the cylindrical substrate to an at least substantially planar back surface at an opposing second end of the cylindrical substrate, the at least substantially planar back surface of the cylindrical substrate abutting the at least substantially planar support surface of the at least one cutting element support member, wherein mounting the at least one PDC cutting element on the steel body comprises positioning the at least one PDC cutting element on the steel body such that the at least one PDC cutting element has an exposure over an outer surface of the steel body adjacent the at least one cutting element of between about 30% and about 60% of an average diameter of the at least one PDC cutting element.

12. The method of claim 11, further comprising selecting the steel body to comprise a plurality of blades defining fluid channels therebetween, and wherein mounting the at least one PDC cutting element on the steel body comprises mounting the at least one PDC cutting element on a blade of the plurality of blades.

13. The method of claim 11, wherein the tapered lateral side surface of the at least one cutting element support member has a frustoconical shape.

14. The method of claim 11, further comprising selecting the at least one cutting element support member to comprise a metal alloy.

15. The method of claim 14, further comprising selecting the at least one cutting element support member to comprise steel.

16. The method of claim 11, further comprising selecting the at least one cutting element support member to comprise a cemented carbide material.

17. The method of claim 16, further comprising selecting the at least one cutting element support member to comprise cobalt-cemented tungsten carbide.

18. The method of claim 11, wherein mounting at least one cutting element support member on the steel body comprises brazing the at least one cutting element support member to the steel body.

* * * * *